US010247201B2

(12) United States Patent
Hino et al.

(10) Patent No.: US 10,247,201 B2
(45) Date of Patent: Apr. 2, 2019

(54) BLOWER APPARATUS

(71) Applicant: Nidec Corporation, Kyoto (JP)

(72) Inventors: Yuko Hino, Kyoto (JP); Seung-Sin Yoo, Kyoto (JP); Tomoyuki Tsukamoto, Kyoto (JP); Akihiko Makita, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 184 days.

(21) Appl. No.: 15/615,115

(22) Filed: Jun. 6, 2017

(65) Prior Publication Data

US 2017/0356463 A1 Dec. 14, 2017

Related U.S. Application Data

(60) Provisional application No. 62/347,380, filed on Jun. 8, 2016.

(30) Foreign Application Priority Data

Mar. 15, 2017 (JP) ..... 2017-049382

(51) Int. Cl.
*F04D 25/06* (2006.01)
*F04D 29/62* (2006.01)
(Continued)

(52) U.S. Cl.
CPC ..... *F04D 29/626* (2013.01); *F04D 17/161* (2013.01); *F04D 25/06* (2013.01);
(Continued)

(58) Field of Classification Search
CPC .... F04D 29/626; F04D 29/281; F04D 17/161; F04D 25/06; F04D 29/083;
(Continued)

(56) References Cited

U.S. PATENT DOCUMENTS 2,632,598 A * 3/1953 Wales, Jr. ..... F04D 17/161 188/264 R
6,726,443 B2 * 4/2004 Collins ..... F01D 1/34 415/90

(Continued)

FOREIGN PATENT DOCUMENTS

CN 105022460 A 11/2015
JP 2008-88985 A 4/2008

OTHER PUBLICATIONS

Office Action dated Oct. 8, 2018, issued in counterpart Chinese application No. 201710417851.X. (2 pages).

(Continued)

*Primary Examiner* — Eldon T Brockman
(74) *Attorney, Agent, or Firm* — Westerman, Hattori, Daniels & Adrian, LLP

(57) ABSTRACT

This blower apparatus includes an air blowing portion, a motor portion, and a housing. The housing includes an air inlet and an air outlet. The air blowing portion includes a plurality of flat plates arranged with an axial gap defined between adjacent ones of the flat plates; and a spacer arranged between the flat plates. A rotating portion of the motor portion includes a hub including a flat plate holding portion arranged to hold at least one of the flat plates. An air flow is generated between the flat plates by viscous drag of surfaces of the flat plates and a centrifugal force. With the spacer being arranged between the flat plates, the axial gap can be adjusted. Since at least one of the flat plates is held by the flat plate holding portion, the air blowing portion is able to stably rotate.

10 Claims, 14 Drawing Sheets

(51) Int. Cl.

| | |
|---|---|
| ***F04D 29/08*** | (2006.01) |
| ***F04D 17/16*** | (2006.01) |
| ***F04D 29/28*** | (2006.01) |
| *F04D 29/42* | (2006.01) |

(52) U.S. Cl.
CPC ..... *F04D 29/083* (2013.01); *F04D 29/281* (2013.01); *F04D 25/064* (2013.01); *F04D 29/4246* (2013.01)

(58) Field of Classification Search
CPC .... F04D 29/4246; F04D 25/064; F04B 35/04; F04B 17/00; G06F 1/20; G06F 1/203; G06F 1/206; H05K 7/20327; H05K 7/20272; H05K 7/207
See application file for complete search history.

(56) References Cited

U.S. PATENT DOCUMENTS

| | | | | |
|---|---|---|---|---|
| 7,455,504 | B2 * | 11/2008 | Hill | F04D 29/281 416/179 |
| 9,366,263 | B2 * | 6/2016 | Tamaoka | F04D 25/062 |
| 9,464,638 | B2 * | 10/2016 | Cepeda-Rizo | F04D 29/58 |
| 9,846,462 | B2 | 12/2017 | Chen et al. | |
| 9,976,570 | B2 * | 5/2018 | Hino | F04B 35/04 |
| 2002/0195886 | A1 | 12/2002 | Collins et al. | |
| 2013/0004114 | A1 * | 1/2013 | Hasegawa | F04D 17/16 384/607 |
| 2016/0032929 | A1 * | 2/2016 | Hasegawa | F04D 17/16 417/423.12 |
| 2017/0300094 | A1 * | 10/2017 | Delano | F04D 29/281 |

OTHER PUBLICATIONS

Related co-pending application: U.S. Appl. No. 15/608,270, filed May 30, 2017, counterpart Japanese Patent Application No. 2017-049380.
Related co-pending application: U.S. Appl. No. 15/608,321, filed May 30, 2017, counterpart Japanese Patent Application No. 2017-049381.
Related co-pending application: U.S. Appl. No. 15/608,366, filed May 30, 2017, counterpart Japanese Patent Application No. 2017-049383.
Related co-pending application: U.S. Appl. No. 15/608,446, filed May 30, 2017, counterpart Japanese Patent Application No. 2017-049384.
Related co-pending application: U.S. Appl. No. 15/608,482, filed May 30, 2017, counterpart Japanese Patent Application No. 2017-049385.
Related co-pending application: U.S. Appl. No. 15/615,143, filed Jun. 6, 2017, counterpart Japanese Patent Application No. 2017-049386.
Related co-pending application: U.S. Appl. No. 15/615,202, filed Jun. 6, 2017, counterpart Japanese Patent Application No. 2017-049387.
Related co-pending application: U.S. Appl. No. 15/615,234, filed Jun. 6, 2017, counterpart Japanese Patent Application No. 2017-049388.
Related co-pending application: U.S. Appl. No. 15/615,279, filed Jun. 6, 2017, counterpart Japanese Patent Application No. 2017-049389.
Related co-pending application: U.S. Appl. No. 15/615,316, filed Jun. 6, 2017, counterpart Japanese Patent Application No. 2017-049390.

* cited by examiner

BLOWER APPARATUS

BACKGROUND OF THE INVENTION

1. Field of the Invention

The present invention relates to a blower apparatus.

2. Description of the Related Art

A centrifugal blower apparatus which generates an air flow traveling radially outward by rotating an impeller including a plurality of blades is known. A known blower apparatus including an impeller is described in, for example, JP-A 2008-88985.

In the blower apparatus described in JP-A 2008-88985, a plurality of blades referred to as fan blades push surrounding gas to generate air flows traveling radially outward.

SUMMARY OF THE INVENTION

In recent years, there has still been a demand for reductions in the size and thickness of electronic devices. Accordingly, there has also been a demand for a reduction in the thickness of blower apparatuses used to cool the interiors of the electronic devices.

Here, in the case where an impeller is used to generate air flows, as in the blower apparatus described in JP-A 2008-88985, air flows pushed by a blade leak from axially upper and lower ends of the blade while the impeller is rotating. As a result, air pressure is lower at the axially upper and lower ends of the blade than in the vicinity of an axial middle of the blade. Accordingly, a reduction in the thickness of the blower apparatus, which involves a reduction in the axial dimension of the impeller, will result in a failure to secure sufficient air blowing efficiency.

An object of the present invention is to provide a technique for realizing a centrifugal blower apparatus which is excellent in air blowing efficiency.

A blower apparatus according to a preferred embodiment of the present invention includes an air-blowing portion arranged to rotate about a central axis extending in a vertical direction; a motor portion arranged to rotate the air blowing portion; and a housing arranged to house the air blowing portion and the motor portion. The housing includes an air inlet arranged above the air blowing portion, and arranged to pass through a portion of the housing in an axial direction; and an air outlet arranged to face in a radial direction at at least one circumferential position radially outside of the air blowing portion. The air blowing portion includes a plurality of flat plates arranged in the axial direction with an axial gap defined between adjacent ones of the flat plates; and one or a plurality of spacers each of which is arranged in a region in the axial gap between axially adjacent ones of the flat plates, the region covering a portion of a radial extent of the axial gap. The motor portion includes a stationary portion including an armature; and a rotating portion including a magnet arranged radially outside of the armature, and a hub arranged to hold the magnet. The hub includes a top plate portion arranged to cover an upper side of the armature; a magnet holding portion arranged to extend downward from the top plate portion to assume a cylindrical shape, and arranged to hold the magnet with an inner circumferential surface thereof; and a flat plate holding portion arranged to extend radially on a radially outer side of the magnet holding portion, and hold at least one of the flat plates.

According to the above preferred embodiment of the present invention, once the air blowing portion starts rotating, an air flow traveling radially outward is generated in the axial gap between the adjacent ones of the flat plates by viscous drag of surfaces of the flat plates and a centrifugal force. Since the air flow is generated between the flat plates, the air flow does not easily leak upwardly or downwardly, and thus, an improvement in air blowing efficiency is achieved. In addition, with the spacer being arranged between the flat plates, the axial gap can be adjusted to have a desired axial dimension. This allows desired air blowing performance to be easily achieved. Further, since the flat plates are held by the flat plate holding portion, the air blowing portion is able to stably rotate. Accordingly, a further improvement in the air blowing efficiency can be achieved. Thus, a reduced thickness of the blower apparatus according to the above preferred embodiment of the present invention does not result in a significant reduction in the air blowing efficiency. In addition, the blower apparatus according to the above preferred embodiment of the present invention is superior to a comparable centrifugal fan including an impeller in terms of being silent.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, blower apparatuses according to preferred embodiments of the present invention will be described. It is assumed herein that a side on which an upper plate portion is arranged with respect to a lower plate portion is an upper side, and the shape of each member or portion and relative positions of different members or portions will be described based on the above assumption. It should be noted, however, that the above definition of the upper and lower sides is not meant to restrict in any way the orientation of a blower apparatus according to any preferred embodiment of the present invention at the time of manufacture or when in use.

1. First Preferred Embodiment

Figure 1:
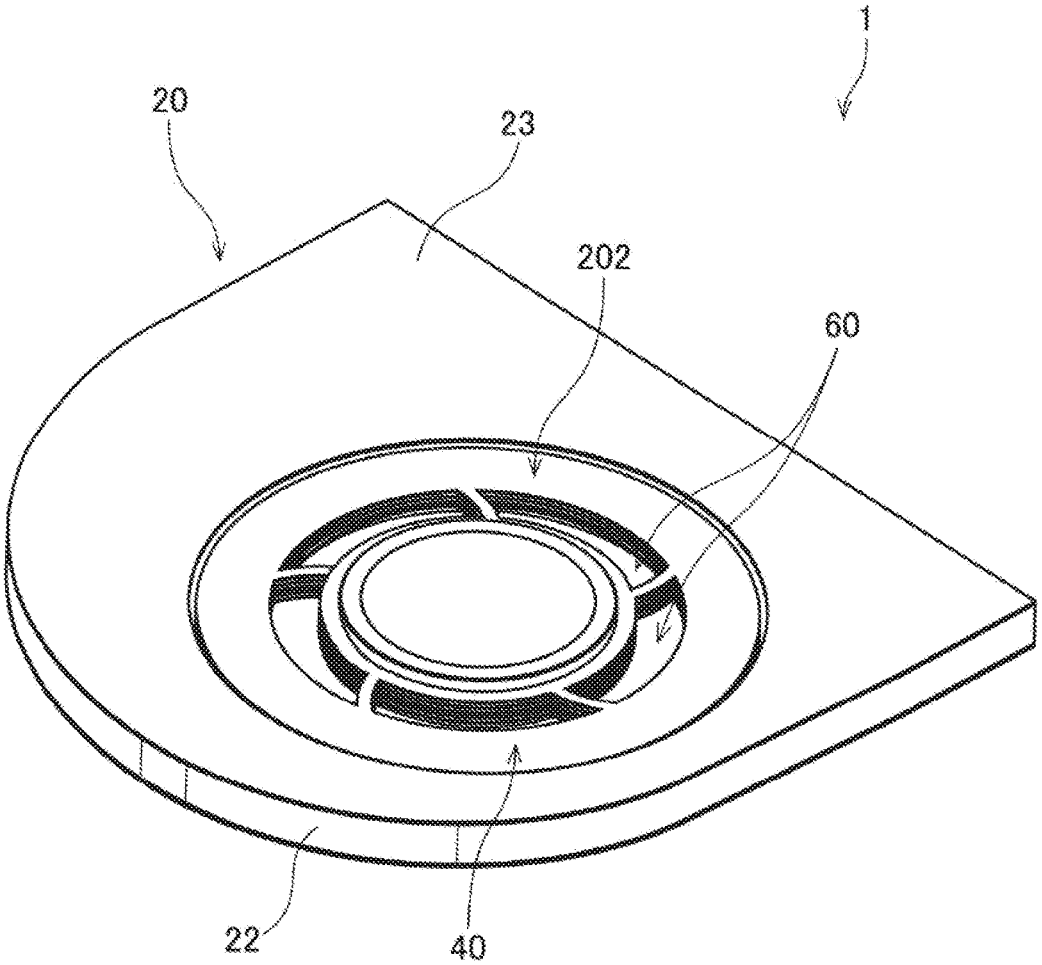
FIG. 1 is a perspective view of a blower apparatus according to a first preferred embodiment of the present invention.
Figure 2:
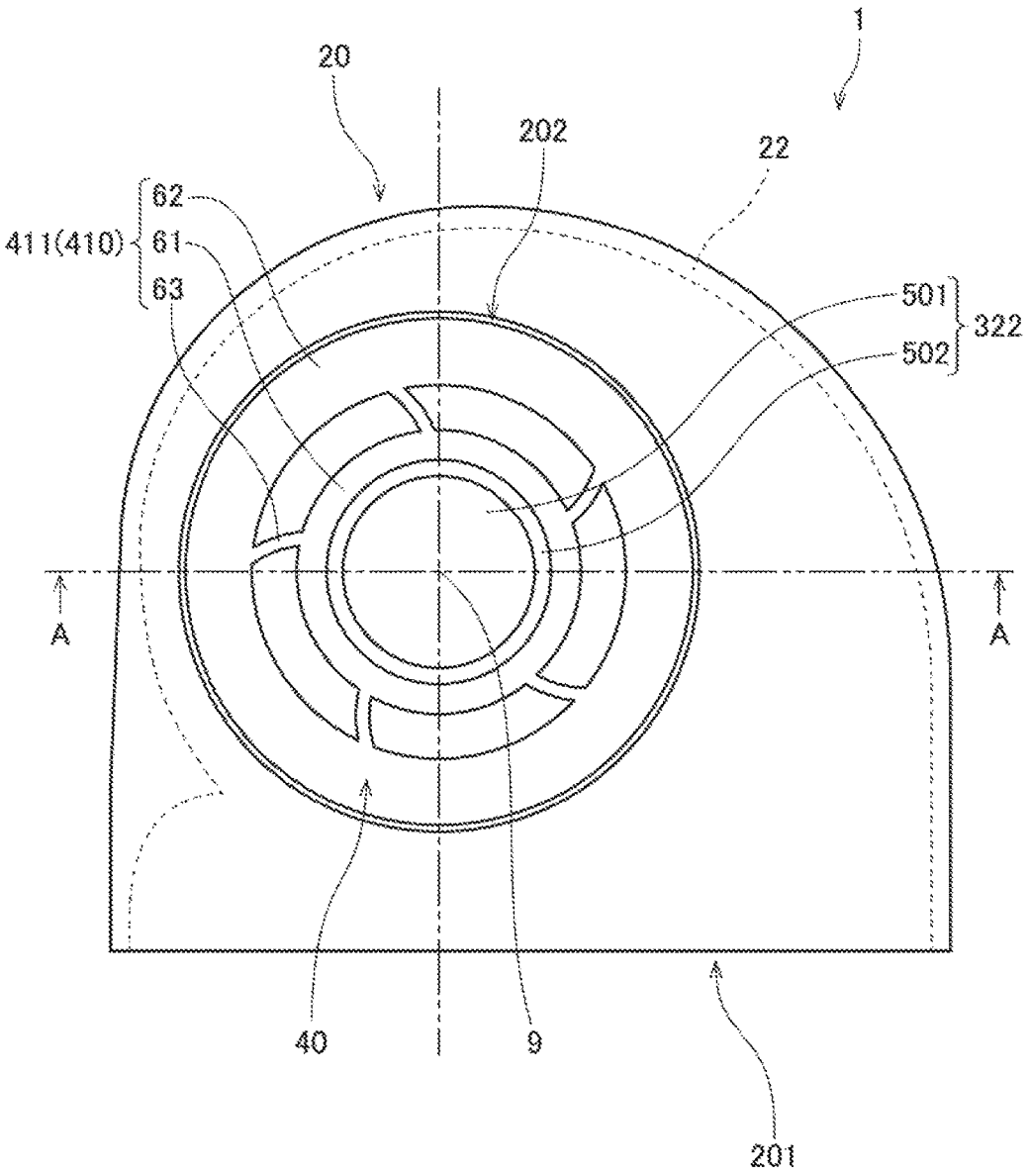
FIG. 2 is a top view of the blower apparatus according to the first preferred embodiment.
Figure 3:
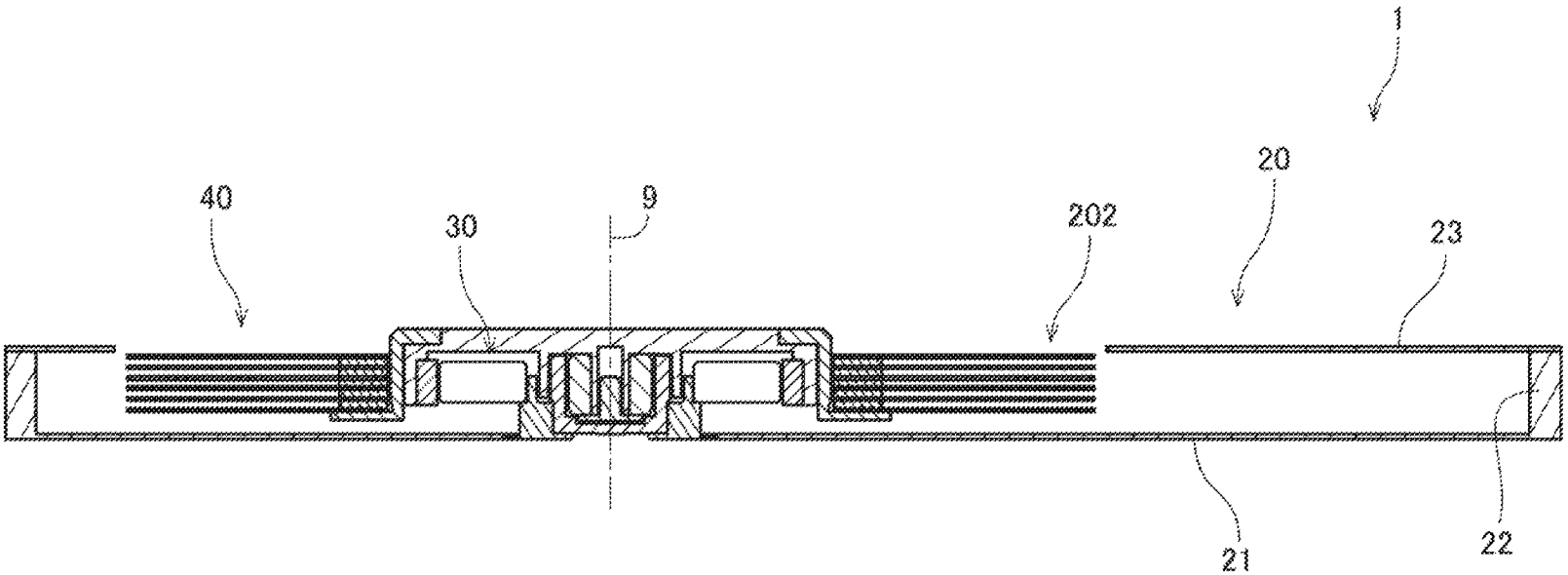
FIG. 3 is a sectional view of the blower apparatus according to the first preferred embodiment.
Figure 4:
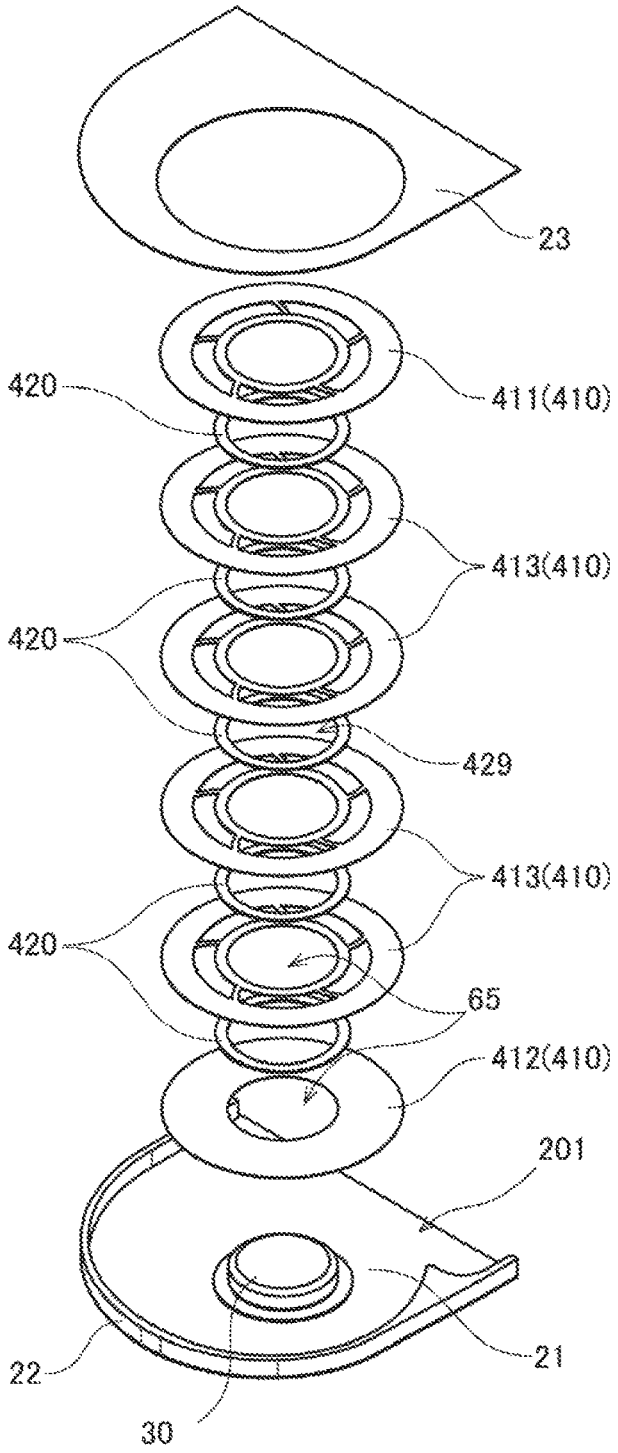
FIG. 4 is an exploded perspective view of the blower apparatus according to the first preferred embodiment.
Figure 5:
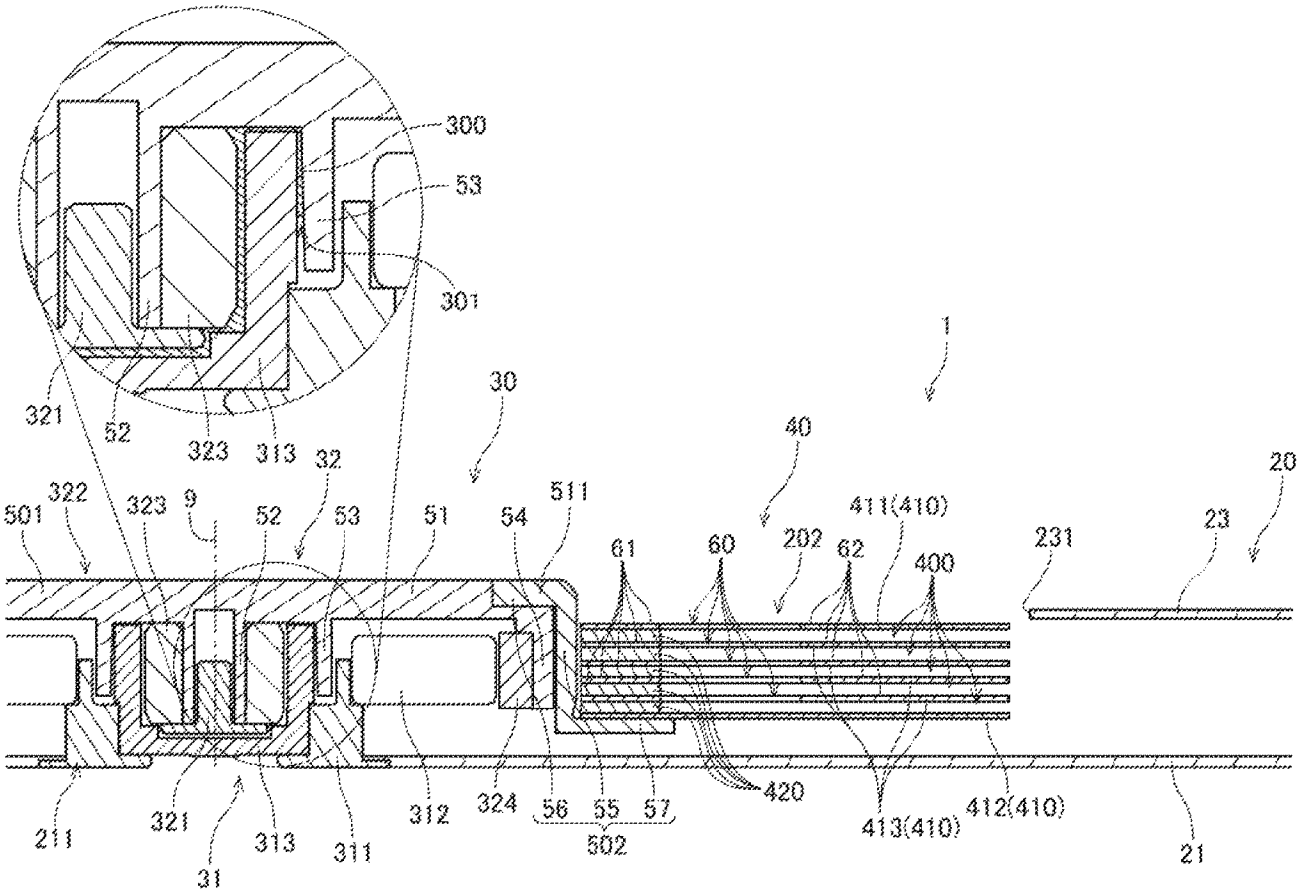
FIG. 5 is a partial sectional view of the blower apparatus according to the first preferred embodiment.

FIG. 1 is a perspective view of a blower apparatus 1 according to a first preferred embodiment of the present invention. FIG. 2 is a top view of the blower apparatus 1. FIG. 3 is a sectional view of the blower apparatus 1 taken along line A-A in FIG. 2. FIG. 4 is an exploded perspective view of the blower apparatus 1. FIG. 5 is a partial sectional view of the blower apparatus 1. The blower apparatus 1 is a centrifugal blower apparatus designed to generate an air flow traveling radially outward by rotating an air blowing portion 40. The blower apparatus 1 is, for example, installed in an electronic device, such as, for example, a personal computer, to cool an interior thereof. Note that the blower apparatus 1 according to a preferred embodiment of the present invention may alternatively be used for other purposes.

Referring to FIGS. 1 to 4, the blower apparatus 1 includes a housing 20, a motor portion 30, and the air blowing portion 40.

The housing 20 is a case arranged to house the motor portion 30 and the air blowing portion 40. The housing 20 includes a lower plate portion 21, a side wall portion 22, and an upper plate portion 23.

The lower plate portion 21 is arranged to define a bottom portion of the housing 20. The lower plate portion 21 is arranged to extend radially below the air blowing portion 40 to cover at least a portion of a lower side of the air blowing portion 40. In addition, the lower plate portion 21 is arranged to support the motor portion 30.

The side wall portion 22 is arranged to extend upward from the lower plate portion 21. The side wall portion 22 is arranged to cover a lateral side of the air blowing portion 40 between the lower plate portion 21 and the upper plate portion 23. In addition, the side wall portion 22 includes an air outlet 201 arranged to face in a radial direction at one circumferential position. In the present preferred embodiment, the lower plate portion 21 and the side wall portion 22 are defined integrally with each other. Note that the lower plate portion 21 and the side wall portion 22 may alternatively be defined by separate members.

The upper plate portion 23 is arranged to define a cover portion of the housing 20. The upper plate portion 23 is arranged to extend radially above the lower plate portion 21. In addition, the upper plate portion 23 includes an air inlet 202 arranged to pass therethrough in an axial direction. In other words, the upper plate portion 23 includes an inner edge portion 231 arranged to define the air inlet 202. The air inlet 202 is, for example, circular and is centered on a central axis 9 in a plan view.

The motor portion 30 is a driving portion arranged to rotate the air blowing portion 40. Referring to FIG. 5, the motor portion 30 includes a stationary portion 31 and a rotating portion 32. The stationary portion 31 is fixed to the lower plate portion 21. The stationary portion 31 is thus arranged to be stationary relative to the housing 20. The rotating portion 32 is supported to be rotatable about the central axis 9 with respect to the stationary portion 31.

The stationary portion 31 includes a stator fixing portion 311, a stator 312, and a bearing housing 313.

The stator fixing portion 311 is fitted in a fixing hole 211 defined in the lower plate portion 21. As a result, the stator fixing portion 311 is fixed to the lower plate portion 21. The stator fixing portion 311 is arranged to extend upward from the fixing hole 211 to assume a cylindrical shape with the central axis 9 as a center thereof. The stator 312 is fixed to an outer circumferential portion of an upper portion of the stator fixing portion 311.

The stator 312 is an armature arranged to generate magnetic flux in accordance with electric drive currents supplied from an external source. The stator 312 is arranged to annularly surround the central axis 9, which extends in a vertical direction. The stator 312 includes, for example, an annular stator core defined by laminated steel sheets, and conducting wires wound around the stator core.

The bearing housing 313 is a member being cylindrical and having a closed bottom. Specifically, the bearing housing 313 includes a disk-shaped bottom portion, and a cylindrical portion arranged to extend upward from the bottom portion. The bearing housing 313 is fixed to an inner circumferential surface of the stator fixing portion 311.

The rotating portion 32 includes a shaft 321, a hub 322, a bearing member 323, and a magnet 324.

The shaft 321 is a member arranged to extend along the central axis 9. The shaft 321 according to the present preferred embodiment includes a columnar portion arranged inside of a first cylindrical portion 52, which will be described below, and arranged to extend with the central axis 9 as a center thereof, and a disk-shaped portion arranged to extend radially from a lower end portion of the columnar portion.

The hub 322 is fixed to the shaft 321. The hub 322 is made up of a hub body member 501 and a flange member 502. The hub body member 501 includes a top plate portion 51, the first cylindrical portion 52, a second cylindrical portion 53, and a magnet holding portion 54. The flange member 502 includes an outer wall portion 55, a top plate fixing portion 56, and a flat plate holding portion 57.

The top plate portion 51 is a disk-shaped portion arranged to extend radially with the central axis 9 as a center thereof. The top plate portion 51 is arranged above the stator 312. The top plate portion 51 has a recessed portion 511 recessed from an upper surface thereof at an outer edge portion thereof.

The first cylindrical portion 52 is arranged to extend downward from the top plate portion 51 to assume a cylindrical shape with the central axis 9 as a center thereof. The columnar portion of the shaft 321 is housed in the first cylindrical portion 52. In addition, the shaft 321 is fixed to the first cylindrical portion 52.

The second cylindrical portion 53 is arranged to extend downward from the top plate portion 51 to assume a cylindrical shape with the central axis 9 as a center thereof. The second cylindrical portion 53 is arranged to have an inside diameter greater than an outside diameter of the first cylindrical portion 52. In other words, the second cylindrical portion 53 is arranged radially outside of the first cylindrical portion 52.

The magnet holding portion 54 is arranged to extend downward from a radially outer end of the top plate portion 51 to assume a cylindrical shape with the central axis 9 as a center thereof. The magnet holding portion 54 is arranged radially outside of the stator 312. The magnet 324 is fixed to an inner circumferential surface of the magnet holding portion 54.

The outer wall portion 55 is a cylindrical portion arranged to extend in the vertical direction with the central axis 9 as a center thereof. The outer wall portion 55 is arranged to extend along an outer circumferential surface of the magnet holding portion 54 of the hub body member 501.

The top plate fixing portion 56 is arranged to extend radially inward from an upper end portion of the outer wall portion 55 to assume the shape of a circular ring. The top plate fixing portion 56 is arranged in the recessed portion 511, which is defined in the upper surface of the top plate portion 51 of the hub body member 501. In addition, the upper surface of the top plate portion 51 and an upper surface of the top plate fixing portion 56 are arranged at the same axial position.

The flat plate holding portion 57 is arranged to extend radially outward from a lower end portion of the outer wall portion 55. The flat plate holding portion 57 is arranged to hold the air blowing portion 40 on a radially outer side of the magnet holding portion 54 of the hub body member 501. In the present preferred embodiment, the air blowing portion 40 is mounted on an upper surface of the flat plate holding portion 57. The flat plate holding portion 57 is thus arranged to stably hold a plurality of flat plates 410 and a plurality of spacers 420 included in the air blowing portion 40.

The bearing member 323 is a cylindrical member arranged to extend in the vertical direction with the central axis 9 as a center thereof. The bearing member 323 is arranged to extend along an outer circumferential surface of the first cylindrical portion 52 of the hub body member 501. In addition, the bearing member 323 is fixed to the outer circumferential surface of the first cylindrical portion 52. The cylindrical portion of the bearing housing 313 is arranged radially outside of the bearing member 323 and radially inside of the second cylindrical portion 53 of the hub body member 501.

The magnet 324 is fixed to the inner circumferential surface of the magnet holding portion 54 of the hub body member 501. In addition, the magnet 324 is arranged radially outside of the stator 312. The magnet 324 according to the present preferred embodiment is in the shape of a circular ring. A radially inner surface of the magnet 324 is arranged radially opposite to the stator 312 with a slight gap therebetween. In addition, an inner circumferential surface of the magnet 324 includes north and south poles arranged to alternate with each other in a circumferential direction. Note that a plurality of magnets may be used in place of the magnet 324 in the shape of a circular ring. In the case where the plurality of magnets are used, the magnets are arranged in the circumferential direction such that north and south poles of the magnets alternate with each other.

As illustrated in an enlarged view in FIG. 5, a lubricating fluid 300 is arranged between the bearing housing 313 and a combination of the shaft 321, the bearing member 323, and the hub body member 501. A polyolester oil or a diester oil, for example, is used as the lubricating fluid 300. The shaft 321, the hub 322, and the bearing member 323 are supported to be rotatable with respect to the bearing housing 313 through the lubricating fluid 300. Thus, in the present preferred embodiment, the bearing housing 313, which is a component of the stationary portion 31, the combination of the shaft 321, the bearing member 323, and the hub body member 501, each of which is a component of the rotating portion 32, and the lubricating fluid 300 together define a fluid dynamic bearing.

A surface of the lubricating fluid 300 is defined in a seal portion 301, which is a gap between an outer circumferential surface of the bearing housing 313 and an inner circumferential surface of the second cylindrical portion 53 of the hub body member 501. In the seal portion 301, the distance between the outer circumferential surface of the bearing housing 313 and the inner circumferential surface of the second cylindrical portion 53 is arranged to increase with decreasing height. In other words, in the seal portion 301, the distance between the outer circumferential surface of the bearing housing 313 and the inner circumferential surface of the second cylindrical portion 53 is arranged to increase with increasing distance from the surface of the lubricating fluid 300. Since the radial width of the seal portion 301 thus increases with decreasing height, the lubricating fluid 300 is attracted upward in the vicinity of the surface of the lubricating fluid 300. This reduces the likelihood that the lubricating fluid 300 will leak out of the seal portion 301.

Use of the fluid dynamic bearing as a bearing mechanism that connects the stationary portion 31 and the rotating portion 32 allows the rotating portion 32 to rotate stably. Thus, the likelihood of an occurrence of an unusual sound from the motor portion 30 can be reduced.

Once electric drive currents are supplied to the stator 312 in the motor portion 30 as described above, magnetic flux is generated around the stator 312. Then, interaction between the magnetic flux of the stator 312 and magnetic flux of the magnet 324 produces a circumferential torque between the stationary portion 31 and the rotating portion 32, so that the rotating portion 32 is caused to rotate about the central axis 9 with respect to the stationary portion 31. The air blowing portion 40, which is held by the flat plate holding portion 57 of the rotating portion 32, is caused to rotate about the central axis 9 together with the rotating portion 32.

Referring to FIGS. 4 and 5, the air blowing portion 40 includes the plurality of flat plates 410 and the plurality of spacers 420. The flat plates 410 and the spacers 420 are arranged to alternate with each other in the axial direction. In addition, adjacent ones of the flat plates 410 and the spacers 420 are fixed to each other through, for example, adhesion.

Referring to FIGS. 4 and 5, in the present preferred embodiment, the flat plates 410 include a top flat plate 411, which is arranged at the highest position, a bottom flat plate 412, which is arranged at the lowest position, and four intermediate flat plates 413, which are arranged below the top flat plate 411 and above the bottom flat plate 412. That is, the number of flat plates 410 included in the air blowing portion 40 according to the present preferred embodiment is six. The flat plates 410 are arranged in the axial direction with an axial gap 400 defined between adjacent ones of the flat plates 410.

Each flat plate 410 is made of, for example, a metal material, such as stainless steel, or a resin material. Each flat plate 410 may alternatively be made of, for example, paper. In this case, paper including a glass fiber, a metal wire, or the like in addition to plant fibers may be used. The flat plate 410 is able to achieve higher dimensional accuracy when the flat plate 410 is made of a metal material than when the flat plate 410 is made of a resin material.

In the present preferred embodiment, each of the top flat plate 411 and the four intermediate flat plates 413 is arranged to have the same shape and size. Referring to FIGS. 1, 2, and 5, each of the top flat plate 411 and the intermediate flat plates 413 includes an inner annular portion 61, an outer annular portion 62, a plurality of ribs 63, and a plurality of air holes 60. In the present preferred embodiment, the number of ribs 63 and the number of air holes 60 included in each of the top flat plate 411 and the intermediate flat plates 413 are both five.

The inner annular portion 61 is an annular portion centered on the central axis 9. The inner annular portion 61 has a central hole 65 (see FIG. 4) arranged to pass therethrough in the vertical direction in a center thereof. The outer annular portion 62 is an annular portion arranged radially outside of the inner annular portion 61 with the central axis 9 as a center thereof. Each rib 63 is arranged to join the inner annular portion 61 and the outer annular portion 62 to each other. Each air hole 60 is arranged to be in communication with a space radially outside of the air blowing portion 40 through the axial gap(s) 400 adjacent to the flat plate 410 including the air hole 60 on the upper and/or lower sides of the flat plate 410. Each air hole 60 is arranged at a position overlapping with the air inlet 202 of the housing 20 when viewed in the axial direction.

The bottom flat plate 412 is an annular and plate-shaped member centered on the central axis 9. The bottom flat plate 412 has a central hole 65 arranged to pass therethrough in the vertical direction in a center thereof.

Referring to FIG. 4, each spacer 420 is a member in the shape of a circular ring. The spacers 420 are arranged between the flat plates 410 to secure the axial gaps 400 between the flat plates 410. Each spacer 420 has a central hole 429 arranged to pass therethrough in the vertical direction in a center thereof. The motor portion 30 is arranged in the central holes 65 of the flat plates 410 and the central holes 429 of the spacers 420.

Each spacer 420 is arranged at a position axially coinciding with the inner annular portion 61 of each of the top flat plate 411 and the intermediate flat plates 413. Thus, the spacer 420 is arranged in a region in the corresponding axial gap 400, the region covering only a portion of the radial extent of the corresponding axial gap 400.

Once the motor portion 30 is driven, the air blowing portion 40 is caused to rotate together with the rotating portion 32. As a result, viscous drag of a surface of each flat plate 410 and a centrifugal force together generate an air flow traveling radially outward in the vicinity of the surface of the flat plate 410. Thus, an air flow traveling radially outward is generated in each of the axial gaps 400 between the flat plates 410. Thus, gas above the housing 20 is supplied to each axial gap 400 through the air inlet 202 of the housing 20 and the air holes 60 of the top flat plate 411 and the intermediate flat plates 413, and is discharged out of the blower apparatus 1 through the air outlet 201, which is defined in a side portion of the housing 20.

Here, each flat plate 410 is arranged to have an axial thickness of about 0.1 mm. Meanwhile, each axial gap 400 is arranged to have an axial dimension of about 0.3 mm. The axial dimension of the axial gap 400 is preferably in the range of 0.2 mm to 0.5 mm. An excessively large axial dimension of the axial gap 400 would lead to a separation between an air flow generated by a lower surface of the flat plate 410 on the upper side and an air flow generated by an upper surface of the flat plate 410 on the lower side during rotation of the air blowing portion 40. This separation could result in a failure to generate sufficient static pressure in the axial gap 400 to discharge a sufficient volume of air. Moreover, an excessively large axial dimension of the axial gap 400 would make it difficult to reduce the axial dimension of the blower apparatus 1. Accordingly, in this blower apparatus 1, the axial dimension of the axial gap 400 is arranged to be in the range of 0.2 mm to 0.5 mm. This arrangement allows the blower apparatus 1 to achieve a reduced thickness while allowing an increase in the static pressure in the axial gap 400 to discharge a sufficient volume of air.

Each of the top flat plate 411 and the intermediate flat plates 413 includes the air holes 60. Accordingly, in each of the top flat plate 411 and the intermediate flat plates 413, the outer annular portion 62, which is arranged radially outside of the air holes 60, defines an air blowing region which generates an air flow in the vicinity of a surface thereof. Meanwhile, the bottom flat plate 412 includes no air hole 60. Therefore, in an upper surface of the bottom flat plate 412, an entire region radially outside of a portion of the bottom flat plate 412 which makes contact with the spacer 420 defines an air blowing region. In other words, in the upper surface of the bottom flat plate 412, a region which axially coincides with the air holes 60 and the ribs 63 of the top flat plate 411 and the intermediate flat plates 413, and a region which axially coincides with the outer annular portions 62 thereof, together define the air blowing region. In addition, in a lower surface of the bottom flat plate 412, an entire region radially outside of a portion of the bottom flat plate 412 which makes contact with the flat plate holding portion 57 defines an air blowing region. Notice that an air flow is generated by a lower surface of the flat plate holding portion 57 as well.

As described above, the bottom flat plate 412 has air blowing regions wider than the air blowing regions of the top flat plate 411 and the intermediate flat plates 413. Therefore, the axial gap 400 between the lowest one of the intermediate flat plates 413 and the bottom flat plate 412 is able to have higher static pressure than any other axial gap 400.

Air flows passing downward through the air inlet 202 and the air holes 60 are drawn radially outward in each axial gap 400. Therefore, the air flows passing through the air holes 60 become weaker as they travel downward. In the present preferred embodiment, the bottom flat plate 412 is arranged to have an air blowing region wider than the air blowing regions of the top flat plate 411 and the intermediate flat plates 413 to cause a stronger air flow to be generated in the lowest one of the axial gaps 400 than in any other axial gap 400 to cause the air flows passing downward through the air holes 60 to be drawn toward the lowest axial gap 400. Thus, a sufficient volume of gas is supplied to the lowest axial gap 400 as well. As a result, the air blowing portion 40 achieves improved air blowing efficiency.

In a related-art blower apparatus that generates air flows by rotating an impeller including a plurality of blades, air flows generated by the impeller leak at upper and lower end portions of the impeller. This leakage of the air flows occurs regardless of the axial dimension of the blower apparatus. Therefore, as the blower apparatus is designed to be thinner, an effect of this leakage on the blower apparatus as a whole becomes greater, resulting in lower air blowing efficiency. Meanwhile, in the blower apparatus 1 according to the present preferred embodiment, the air flows are generated in the vicinity of the surfaces of the flat plates 410, and therefore, the air flows do not easily leak upward or downward. Therefore, even when the axial dimension of the air blowing portion 40, which generates the air flows, is reduced, a reduction in air blowing efficiency due to leakages of the air flows does not easily occur.

Further, since the air blowing portion 40 is held by the flat plate holding portion 57, which extends radially, the air blowing portion 40 is able to stably rotate. Accordingly, an improvement in the air blowing efficiency can be achieved. In addition, with the spacers 420 arranged between the flat plates 410, each axial gap 400 can be adjusted to have a desired axial dimension. This allows desired air blowing performance to be easily achieved. Accordingly, the blower apparatus 1 is able to achieve improved air blowing efficiency even when the thickness of the blower apparatus 1 is reduced.

In addition, in a blower apparatus including an impeller, periodic noise occurs owing to the shape, number, arrangement, and so on of blades. However, this blower apparatus 1 is superior to a comparable blower apparatus including an impeller in terms of being silent, because the air flows are generated by the viscous drag of the surface of each flat plate 410 and the centrifugal force in the blower apparatus 1. In particular, since the air blowing portion 40 is able to stably rotate as described above, a further reduction in noise can be achieved.

In addition, from the viewpoint of P-Q characteristics (i.e., flow rate-static pressure characteristics), the blower apparatus 1 including the flat plates 410 is able to produce a higher static pressure in a low flow rate region than the blower apparatus including the impeller. Therefore, when compared to the blower apparatus including the impeller, the blower apparatus 1 is suitable for use in a densely packed case, from which only a relatively small volume of air can be discharged. Examples of such cases include cases of electronic devices, such as, for example, personal computers.

In the present preferred embodiment, the top flat plate 411 and all the intermediate flat plates 413 include the air holes 60. Accordingly, all the axial gaps 400 are in axial communication with a space above the housing 20 through the air inlet 202 and the air holes 60.

Referring to FIG. 2, the air inlet 202 is centered on the central axis 9. That is, a center of the air inlet 202 coincides with the central axis 9. Meanwhile, the air blowing portion 40 is also centered on the central axis 9. Accordingly, differences in pressure do not easily occur at different circumferential positions in the air blowing portion 40. This contributes to reducing noise. It is assumed that the term "coincide" as used here includes not only "completely coincide" but also "substantially coincide".

2. Example Modifications

While a preferred embodiment of the present invention has been described above, it is to be understood that the present invention is not limited to the above-described preferred embodiment.

Figure 6:
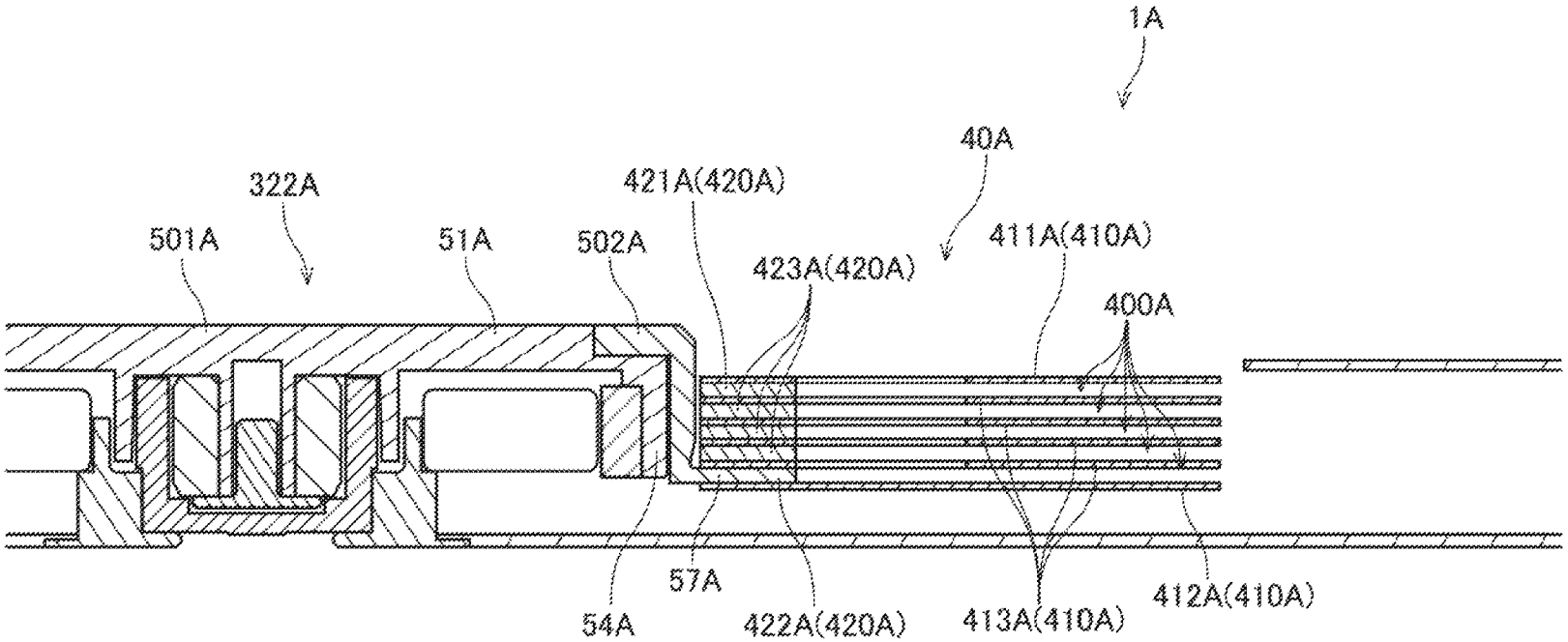
FIG. 6 is a partial sectional view of a blower apparatus according to a modification of the first preferred embodiment.

FIG. 6 is a partial sectional view of a blower apparatus 1A according to a modification of the above-described preferred embodiment. In the blower apparatus 1A according to the modification illustrated in FIG. 6, an air blowing portion 40A includes a plurality of flat plates 410A and a plurality of spacers 420A. The flat plates 410A are arranged in the axial direction with an axial gap 400A defined between adjacent ones of the flat plates 410A. Each of the spacers 420A is arranged in a region in the axial gap 400A between axially adjacent ones of the flat plates 410A, the region covering a portion of the radial extent of the axial gap 400A.

The flat plates 410A include a top flat plate 411A, which is arranged at the highest position, a bottom flat plate 412A, which is arranged at the lowest position, and four intermediate flat plates 413A, which are arranged below the top flat plate 411A and above the bottom flat plate 412A. In addition, the spacers 420A include a top spacer 421A, which is arranged at the highest position, a bottom spacer 422A, which is arranged at the lowest position, and three intermediate spacers 423A, which are arranged below the top spacer 421A and above the bottom spacer 422A.

In addition, a hub 322A includes a hub body member 501A, which includes a top plate portion 51A and a magnet holding portion 54A, and a flange member 502A, which includes a flat plate holding portion 57A arranged to extend radially.

In this blower apparatus 1A, the flat plate holding portion 57A is arranged to perform a function as the bottom spacer 422A of the air blowing portion 40A. In other words, the bottom spacer 422A defines a portion of the flat plate holding portion 57A. The flat plate holding portion 57A is arranged to hold the top flat plate 411A, the four intermediate flat plates 413A, the top spacer 421A, and the three intermediate spacers 423A above an upper surface thereof. In addition, the flat plate holding portion 57A is arranged to hold the bottom flat plate 412A below a lower surface thereof.

Figure 7:
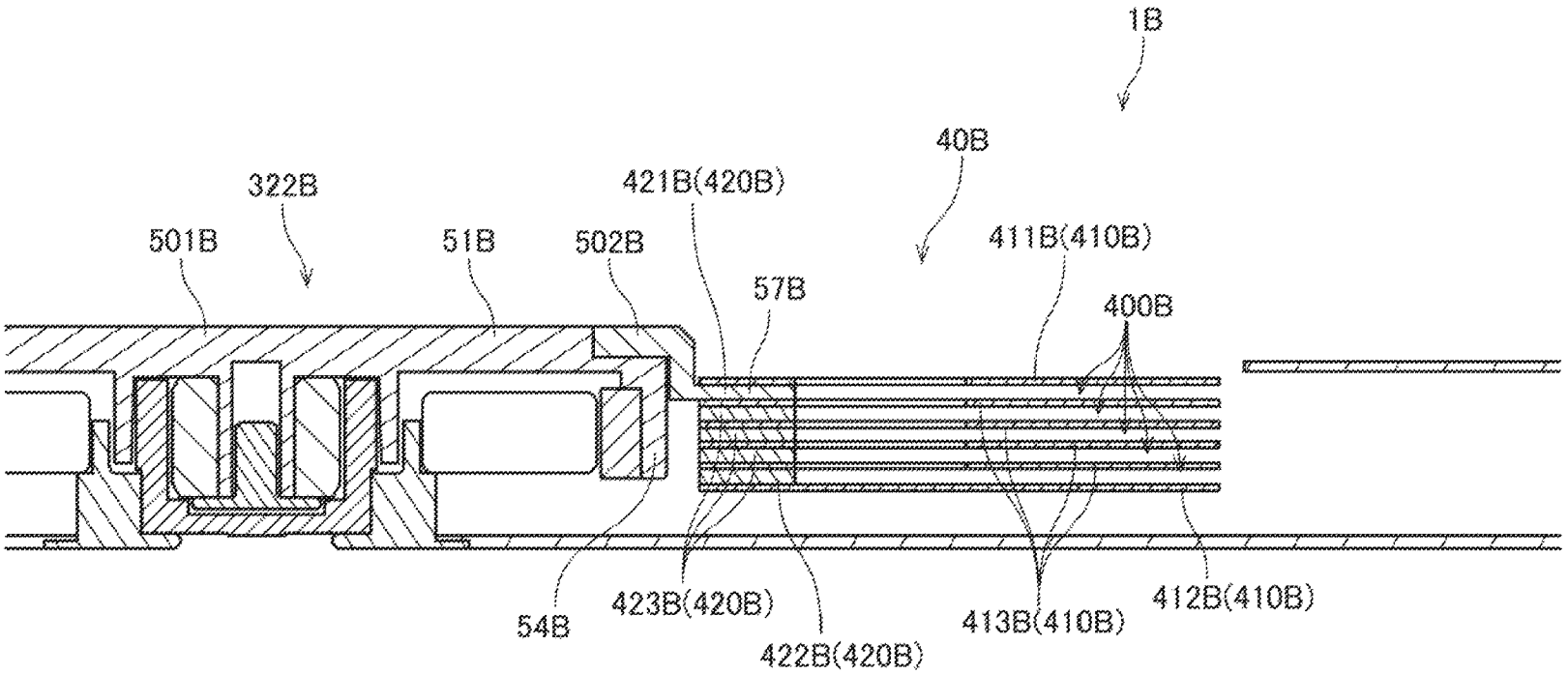
FIG. 7 is a partial sectional view of a blower apparatus according to a modification of the first preferred embodiment.

FIG. 7 is a partial sectional view of a blower apparatus 1B according to another modification of the above-described preferred embodiment. In the blower apparatus 1B according to the modification illustrated in FIG. 7, an air blowing portion 40B includes a plurality of flat plates 410B and a plurality of spacers 420B. The flat plates 410B are arranged in the axial direction with an axial gap 400B defined between adjacent ones of the flat plates 410B. Each of the spacers 420B is arranged in a region in the axial gap 400B between axially adjacent ones of the flat plates 410B, the region covering a portion of the radial extent of the axial gap 400B.

The flat plates 410B include a top flat plate 411B, which is arranged at the highest position, a bottom flat plate 412B, which is arranged at the lowest position, and four intermediate flat plates 413B, which are arranged below the top flat plate 411B and above the bottom flat plate 412B. In addition, the spacers 420B include a top spacer 421B, which is arranged at the highest position, a bottom spacer 422B, which is arranged at the lowest position, and three intermediate spacers 423B, which are arranged below the top spacer 421B and above the bottom spacer 422B.

In addition, a hub 322B includes a hub body member 501B, which includes a top plate portion 51B and a magnet holding portion 54B, and a flange member 502B, which includes a flat plate holding portion 57B arranged to extend radially.

In this blower apparatus 1B, the flat plate holding portion 57B is arranged to perform a function as the top spacer 421B of the air blowing portion 40B. In other words, the top spacer 421B defines a portion of the flat plate holding portion 57B. In addition, the flat plate holding portion 57B is arranged to hold the top flat plate 411B above an upper surface thereof. In addition, the flat plate holding portion 57B is arranged to hold the four intermediate flat plates 413B, the bottom flat plate 412B, the three intermediate spacers 423B, and the bottom spacer 422B below a lower surface thereof.

In a process of manufacturing the blower apparatus 1B, the four intermediate flat plates 413B and the bottom flat plate 412B are placed one below another from one axial side (i.e., a lower surface side) of the flat plate holding portion 578. Therefore, the top plate portion 51B of the hub 322B, which has a flat surface, is placed on a work (i.e., a portion of assembling equipment) when the air blowing portion 40B is assembled. Accordingly, a mounting surface of the work on which the top plate portion 51B of the hub 322B is placed does not need to have a complicated shape, resulting in an improved productivity.

Figure 8:
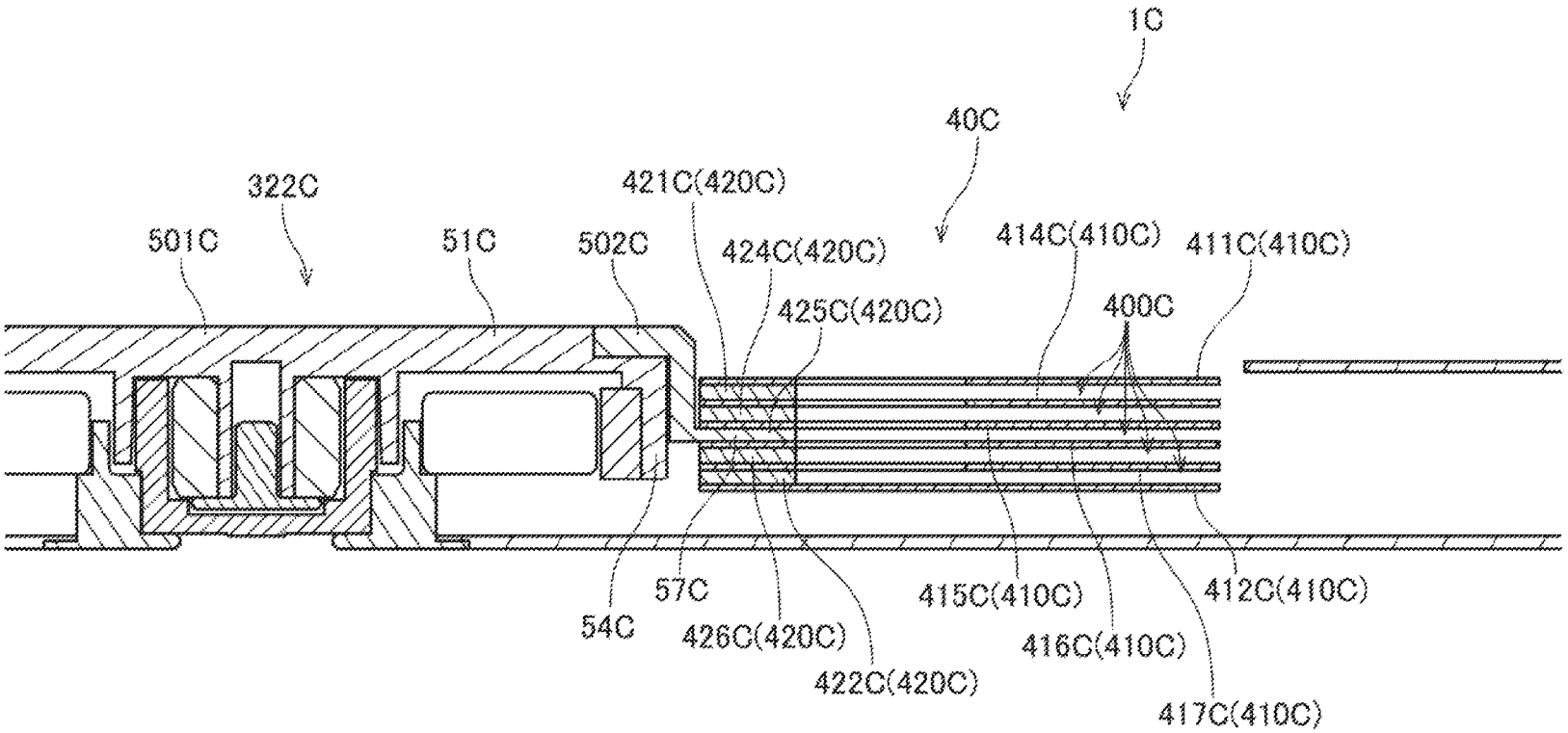
FIG. 8 is a partial sectional view of a blower apparatus according to a modification of the first preferred embodiment.

FIG. 8 is a partial sectional view of a blower apparatus 1C according to yet another modification of the above-described preferred embodiment. In the blower apparatus 1C according to the modification illustrated in FIG. 8, an air blowing portion 40C includes a plurality of flat plates 410C and a plurality of spacers 420C. The flat plates 410C are arranged in the axial direction with an axial gap 400C defined between adjacent ones of the flat plates 410C. Each of the spacers 420C is arranged in a region in the axial gap 400C between axially adjacent ones of the flat plates 410C, the region covering a portion of the radial extent of the axial gap 400C.

The flat plates 410C include a top flat plate 411C, which is arranged at the highest position, a bottom flat plate 412C, which is arranged at the lowest position, and four intermediate flat plates 414C, 415C, 416C, and 417C, which are arranged below the top flat plate 411C and above the bottom flat plate 412C. The four intermediate flat plates 414C to 417C will be hereinafter referred to as, from highest to lowest, a first intermediate flat plate 414C, a second intermediate flat plate 415C, a third intermediate flat plate 416C, and a fourth intermediate flat plate 417C.

The spacers 420C include a top spacer 421C, which is arranged at the highest position, a bottom spacer 422C, which is arranged at the lowest position, and three intermediate spacers 424C, 425C, and 426C, which are arranged below the top spacer 421C and above the bottom spacer 422C. The three intermediate spacers 424C to 426C will be hereinafter referred to as, from highest to lowest, a first intermediate spacer 424C, a second intermediate spacer 425C, and a third intermediate spacer 426C.

In addition, a hub 322C includes a hub body member 501C, which includes a top plate portion 51C and a magnet holding portion 54C, and a flange member 502C, which includes a flat plate holding portion 57C arranged to extend radially.

In this blower apparatus 1C, the flat plate holding portion 57C is arranged to perform a function as the second intermediate spacer 425C of the air blowing portion 40C. In other words, the second intermediate spacer 425C, which is one of the intermediate spacers 424C to 426C, defines a portion of the flat plate holding portion 57C. The flat plate holding portion 57C is arranged to hold the top flat plate 411C, the first intermediate flat plate 414C, the second intermediate flat plate 415C, the top spacer 421C, and the first intermediate spacer 424C above an upper surface thereof. In addition, the flat plate holding portion 57C is arranged to hold the third intermediate flat plate 416C, the fourth intermediate flat plate 417C, the bottom flat plate 412C, the third intermediate spacer 426C, and the bottom spacer 422C below a lower surface thereof.

As in each of the blower apparatuses 1A, 1B, and 1C according to the modifications illustrated in FIGS. 6, 7, and 8, respectively, at least one of the plurality of spacers of the air blowing portion may define a portion of the flat plate holding portion. A reduction in the number of parts can be achieved by defining one of the spacers and the flat plate holding portion integrally with each other. The number of parts to be assembled can thus be reduced, resulting in an improved productivity. Note that, although the air blowing portion includes a plurality of spacers in each of the modifications illustrated in FIGS. 6 to 8, this is not essential to the present invention. The air blowing portion may alternatively include two flat plates and a single spacer. In this case, the single spacer may define a portion of the flat plate holding portion.

Figure 9:
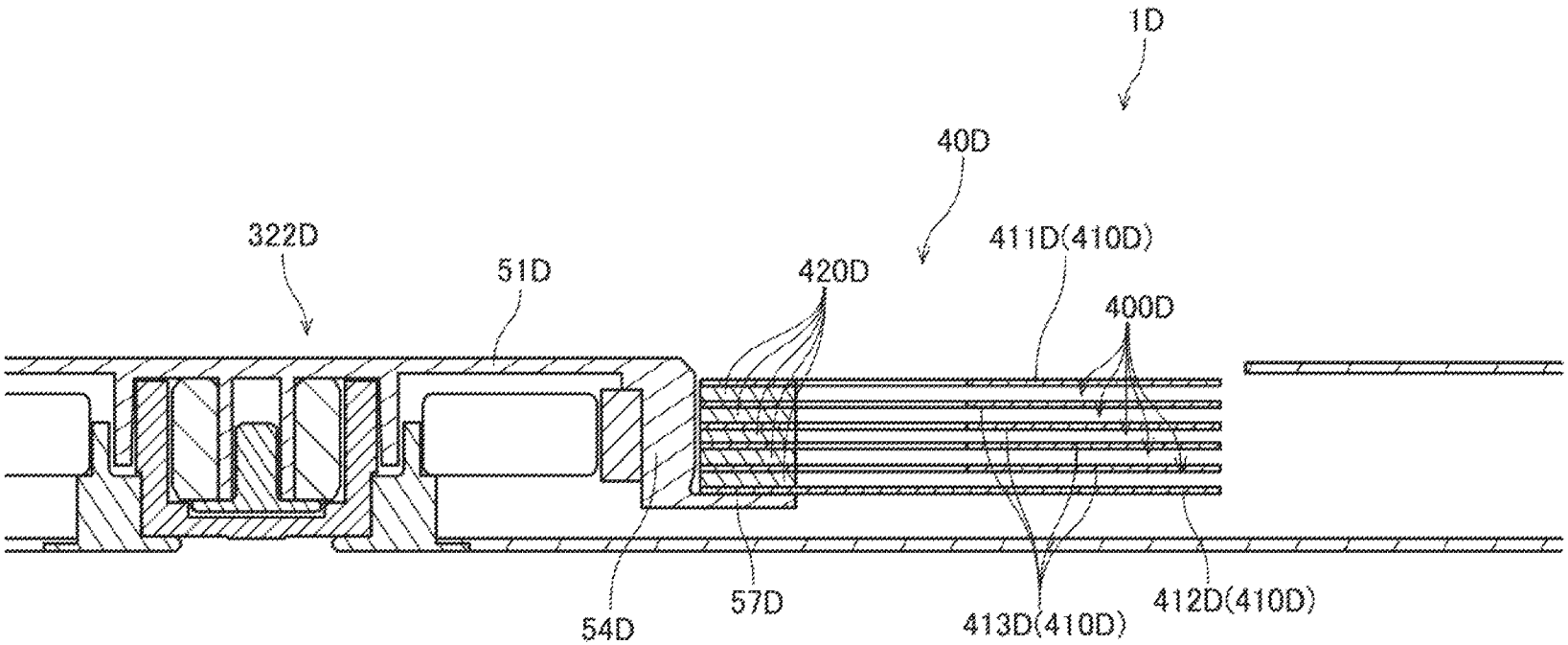
FIG. 9 is a partial sectional view of a blower apparatus according to a modification of the first preferred embodiment.

FIG. 9 is a partial sectional view of a blower apparatus 1D according to yet another modification of the above-described preferred embodiment. In the blower apparatus 1D according to the modification illustrated in FIG. 9, a hub 322D is defined by a single monolithic member including a top plate portion 51D, a magnet holding portion 54D, and a flat plate holding portion 57D. The flat plate holding portion 57D is arranged to extend radially outward from a lower end portion of the magnet holding portion 54D. In addition, an air blowing portion 40D includes a plurality of flat plates 410D and a plurality of spacers 420D. The flat plates 410D are arranged in the axial direction with an axial gap 400D defined between adjacent ones of the flat plates 410D. Each of the spacers 420D is arranged in a region in the axial gap 400D between axially adjacent ones of the flat plates 410D, the region covering a portion of the radial extent of the axial gap 400D. The flat plate holding portion 57D of the hub 322D is arranged to hold the air blowing portion 40D on an upper surface thereof. That is, the flat plate holding portion 57D is arranged to hold the flat plates 410D and the spacers 420D.

Figure 10:
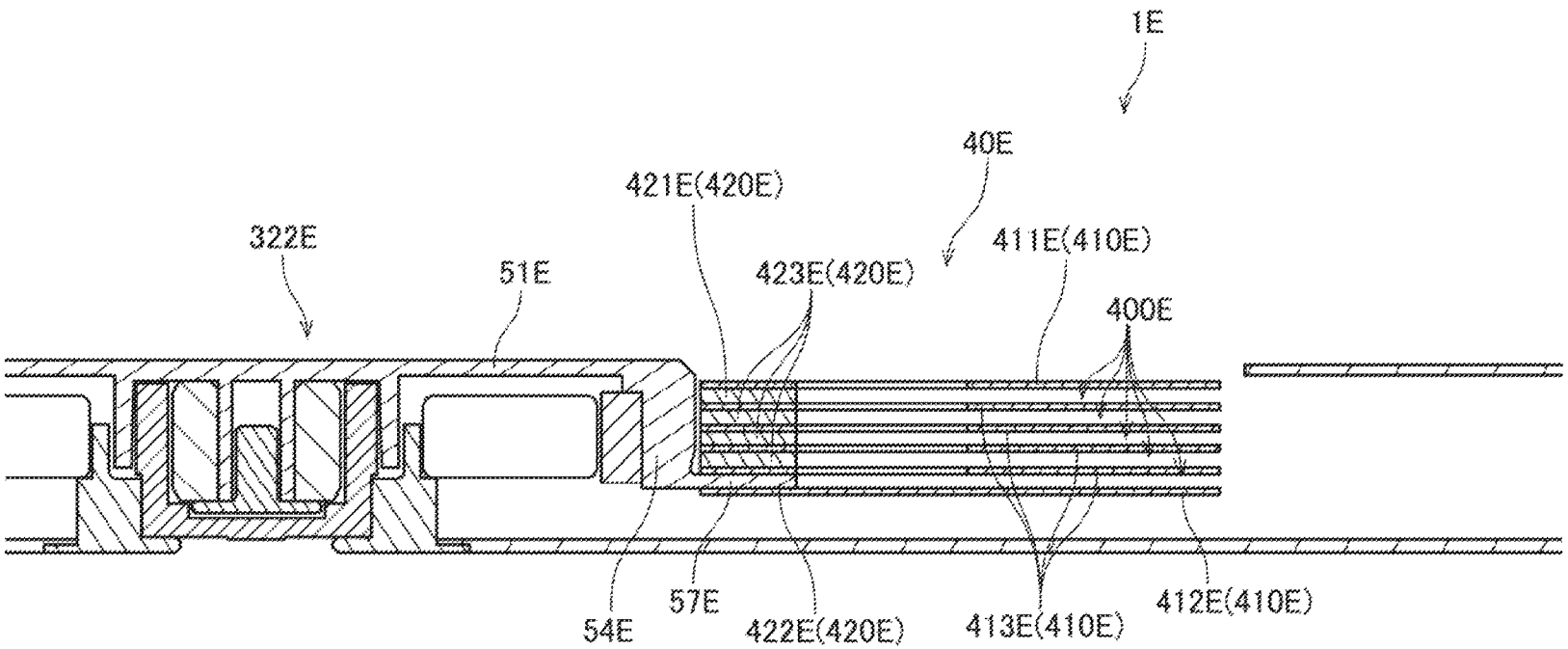
FIG. 10 is a partial sectional view of a blower apparatus according to a modification of the first preferred embodiment.

FIG. 10 is a partial sectional view of a blower apparatus 1E according to yet another modification of the above-described preferred embodiment. In the blower apparatus 1E according to the modification illustrated in FIG. 10, a hub 322E is defined by a single monolithic member including a top plate portion 51E, a magnet holding portion 54E, and a flat plate holding portion 57E. The flat plate holding portion 57E is arranged to extend radially outward from a lower end portion of the magnet holding portion 54E.

In addition, an air blowing portion 40E includes a plurality of flat plates 410E and a plurality of spacers 420E. The flat plates 410E are arranged in the axial direction with an axial gap 400E defined between adjacent ones of the flat plates 410E. Each of the spacers 420E is arranged in a region in the axial gap 400E between axially adjacent ones of the flat plates 410E, the region covering a portion of the radial extent of the axial gap 400E.

The flat plates 410E include a top flat plate 411E, which is arranged at the highest position, a bottom flat plate 412E, which is arranged at the lowest position, and four intermediate flat plates 413E, which are arranged below the top flat plate 411E and above the bottom flat plate 412E. In addition, the spacers 420E include a top spacer 421E, which is arranged at the highest position, a bottom spacer 422E, which is arranged at the lowest position, and three intermediate spacers 423E, which are arranged below the top spacer 421E and above the bottom spacer 422E.

In this blower apparatus 1E, the flat plate holding portion 57E is arranged to perform a function as the bottom spacer 422E of the air blowing portion 40E. In other words, the bottom spacer 422E defines a portion of the flat plate holding portion 57E. The flat plate holding portion 57E is arranged to hold the top flat plate 411E, the four intermediate flat plates 413E, the top spacer 421E, and the three intermediate spacers 423E above an upper surface thereof. In addition, the flat plate holding portion 57E is arranged to hold the bottom flat plate 412E below a lower surface thereof.

Figure 11:
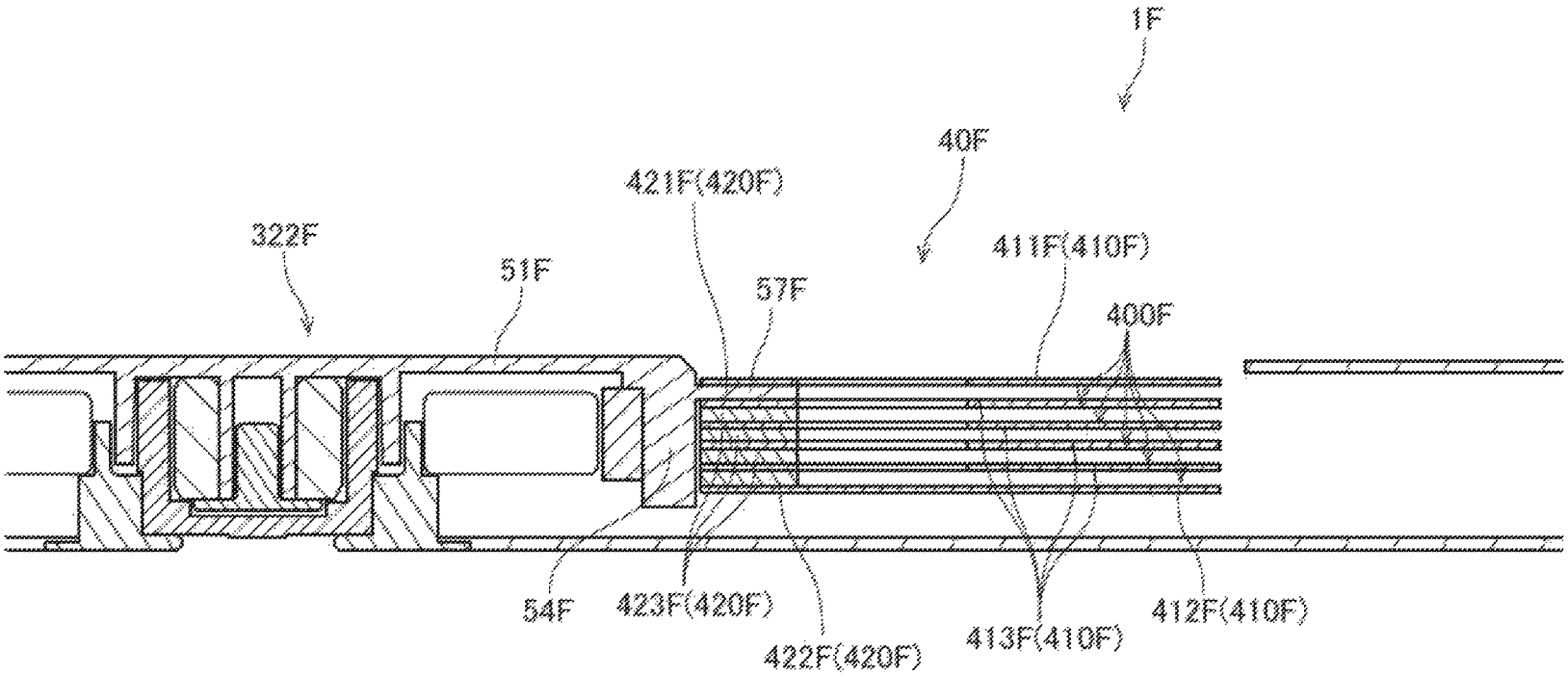
FIG. 11 is a partial sectional view of a blower apparatus according to a modification of the first preferred embodiment.

FIG. 11 is a partial sectional view of a blower apparatus 1F according to yet another modification of the above-described preferred embodiment. In the blower apparatus 1F according to the modification illustrated in FIG. 11, a hub 322F is defined by a single monolithic member including a top plate portion 51F, a magnet holding portion 54F, and a flat plate holding portion 57F. The flat plate holding portion 57F is arranged to extend radially outward from a side surface of the magnet holding portion 54F.

In addition, an air blowing portion 40F includes a plurality of flat plates 410F and a plurality of spacers 420F. The flat plates 410F are arranged in the axial direction with an axial gap 400F defined between adjacent ones of the flat plates 410F. Each of the spacers 420F is arranged in a region in the axial gap 400F between axially adjacent ones of the flat plates 410F, the region covering a portion of the radial extent of the axial gap 400F.

In this blower apparatus 1F, the flat plate holding portion 57F is arranged to perform a function as a top spacer 421F of the air blowing portion 40F. In other words, the top spacer 421F defines a portion of the flat plate holding portion 57F. The flat plate holding portion 57F is arranged to hold a top flat plate 411F above an upper surface thereof. In addition, the flat plate holding portion 57F is arranged to hold four intermediate flat plates 413F, a bottom flat plate 412F, three intermediate spacers 423F, and a bottom spacer 422F below a lower surface thereof.

In a process of manufacturing the blower apparatus 1F, the four intermediate flat plates 413F and the bottom flat plate 412F are placed one below another from one axial side (i.e., a lower surface side) of the flat plate holding portion 57F. Therefore, the top plate portion 51F of the hub 322F, which has a flat surface, is placed on a work (i.e., a portion of assembling equipment) when the air blowing portion 40F is assembled. Accordingly, a mounting surface of the work on which the top plate portion 51F of the hub 322F is placed does not need to have a complicated shape, resulting in an improved productivity.

Figure 12:
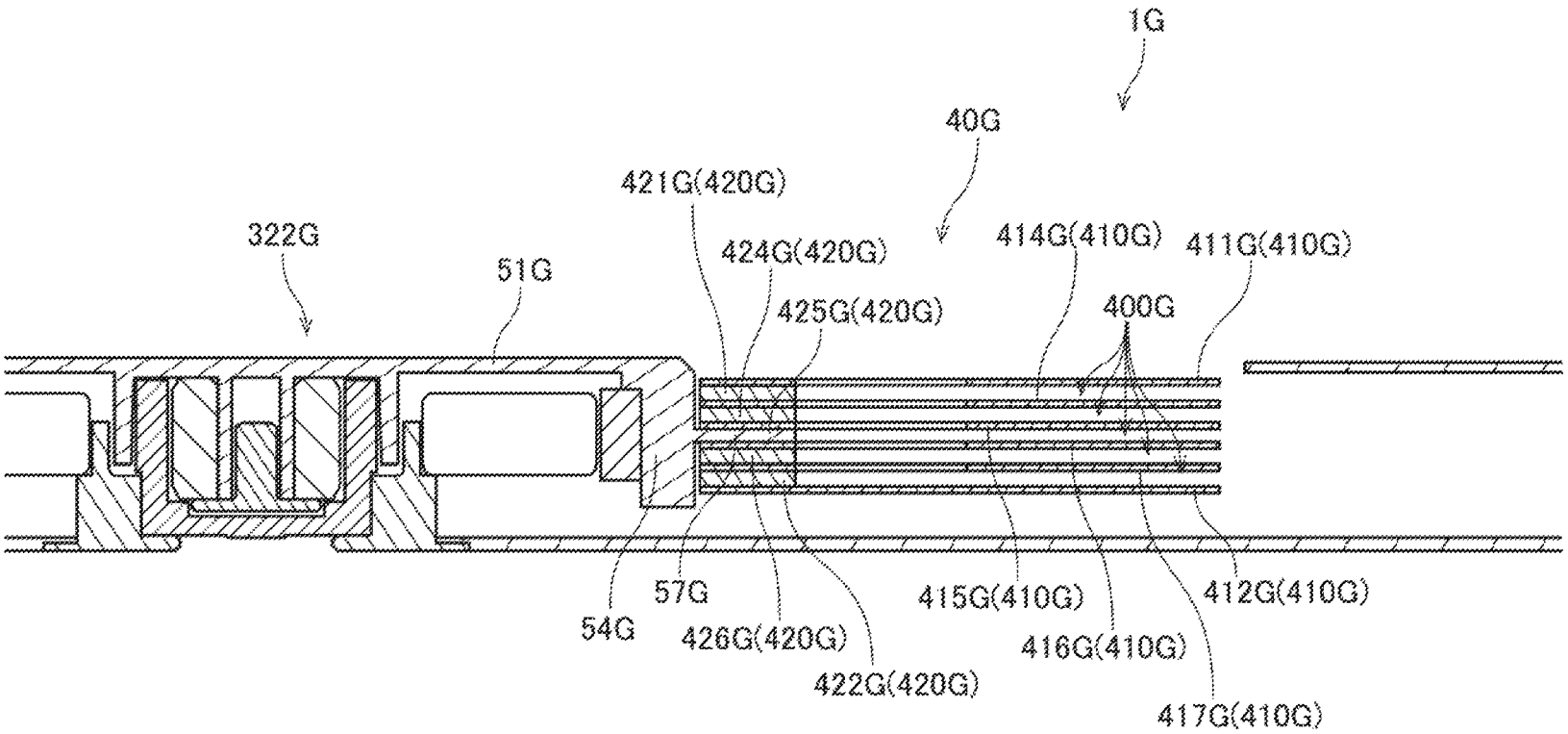
FIG. 12 is a partial sectional view of a blower apparatus according to a modification of the first preferred embodiment.

FIG. 12 is a partial sectional view of a blower apparatus 1G according to yet another modification of the above-described preferred embodiment. In the blower apparatus 1G according to the modification illustrated in FIG. 12, a hub 322G is defined by a single monolithic member including a top plate portion 51G, a magnet holding portion 54G, and a flat plate holding portion 57G. The flat plate holding portion 57G is arranged to extend radially outward from a side surface of the magnet holding portion 54G.

In addition, an air blowing portion 40G includes a plurality of flat plates 410G and a plurality of spacers 420G. The flat plates 410G are arranged in the axial direction with an axial gap 400G defined between adjacent ones of the flat plates 410G. Each of the spacers 420G is arranged in a region in the axial gap 400G between axially adjacent ones of the flat plates 410G, the region covering a portion of the radial extent of the axial gap 400G.

The flat plates 410G include a top flat plate 411G, which is arranged at the highest position, a bottom flat plate 412G, which is arranged at the lowest position, and four intermediate flat plates 414G, 415G, 416G, and 417G, which are arranged below the top flat plate 411G and above the bottom flat plate 412G. The four intermediate flat plates 414G to 417G will be hereinafter referred to as, from highest to lowest, a first intermediate flat plate 414G, a second intermediate flat plate 415G, a third intermediate flat plate 416G, and a fourth intermediate flat plate 417G.

The spacers 420G include a top spacer 421G, which is arranged at the highest position, a bottom spacer 422G, which is arranged at the lowest position, and three intermediate spacers 424G, 425G, and 426G, which are arranged below the top spacer 421G and above the bottom spacer 422G. The three intermediate spacers 424G to 426G will be hereinafter referred to as, from highest to lowest, a first intermediate spacer 424G, a second intermediate spacer 425G, and a third intermediate spacer 426G.

In this blower apparatus 1G, the flat plate holding portion 57G is arranged to perform a function as the second intermediate spacer 425G of the air blowing portion 40G. In other words, the second intermediate spacer 425G, which is one of the intermediate spacers 424G to 426G, defines a portion of the flat plate holding portion 57G. The flat plate holding portion 57G is arranged to hold the top flat plate 411G, the first intermediate flat plate 414G, the second intermediate flat plate 415G, the top spacer 421G, and the first intermediate spacer 424G above an upper surface thereof. In addition, the flat plate holding portion 57G is arranged to hold the third intermediate flat plate 416G, the fourth intermediate flat plate 417G, the bottom flat plate 412G, the third intermediate spacer 426G, and the bottom spacer 422G below a lower surface thereof.

As in each of the blower apparatuses 1D, 1E, 1F, and 1G according to the modifications illustrated in FIGS. 9, 10, 11, and 12, respectively, the hub may be defined by a single monolithic member. In the case where the hub is defined by a single monolithic member, a reduction in the number of parts can be achieved when compared to the case where the hub is defined by a plurality of members. The number of parts to be assembled can thus be reduced, resulting in an improved productivity.

In addition, as in each of the blower apparatuses 1E, 1F, and 1G according to the modifications illustrated in FIGS. 10, 11, and 12, respectively, at least one of the plurality of spacers of the air blowing portion may define a portion of the flat plate holding portion. A further reduction in the number of parts can be achieved by defining one of the spacers and the flat plate holding portion integrally with each other. The number of parts to be assembled can thus be further reduced, resulting in a further improved productivity. Note that, although the air blowing portion includes a plurality of spacers in each of the modifications illustrated in FIGS. 10 to 12, this is not essential to the present invention. The air blowing portion may alternatively include two flat plates and a single spacer. In this case, the single spacer may define a portion of the flat plate holding portion.

Figure 13:
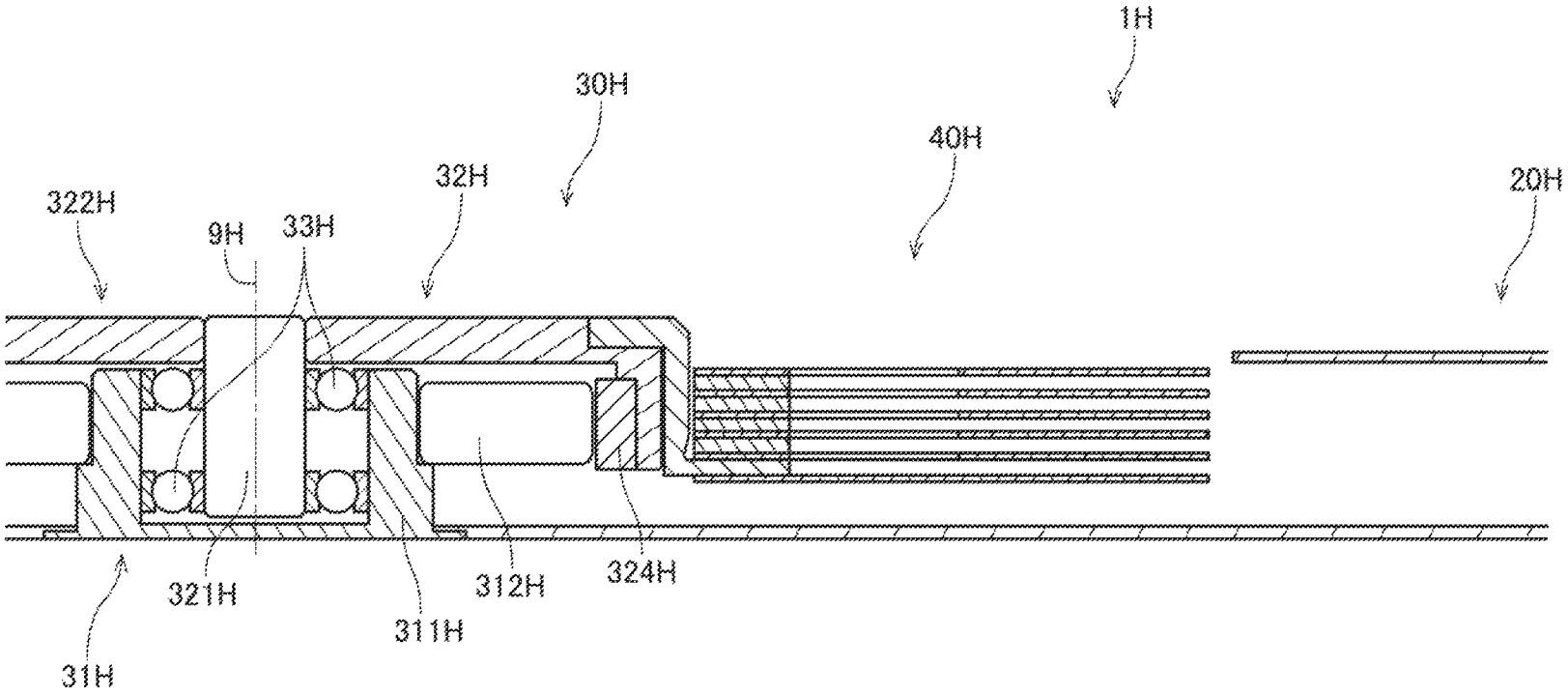
FIG. 13 is a partial sectional view of a blower apparatus according to a modification of the first preferred embodiment.

FIG. 13 is a partial sectional view of a blower apparatus 1H according to yet another modification of the above-described preferred embodiment. In the blower apparatus 1H according to the modification illustrated in FIG. 13, a motor portion 30H includes a stationary portion 31H, a rotating portion 32H, and two ball bearings 33H.

The stationary portion 31H includes a stator fixing portion 311H and a stator 312H. The stator fixing portion 311H is a member being cylindrical and having a closed bottom and fixed to a housing 20H. The stator 312H is an armature fixed to an outer circumferential surface of the stator fixing portion 311H.

The rotating portion 32H includes a shaft 321H, a hub 322H, and a magnet 324H. At least a lower end portion of the shaft 321H is arranged inside of the stator fixing portion 311H. In addition, an upper end portion of the shaft 321H is fixed to the hub 322H. The magnet 324H is fixed to the hub 322H. The magnet 324H is arranged radially opposite to the stator 312H.

Each ball bearing 33H is arranged to connect the rotating portion 32H to the stationary portion 31H such that the rotating portion 32H is rotatable with respect to the stationary portion 31H. Specifically, an outer race of each ball bearing 33H is fixed to an inner circumferential surface of the stator fixing portion 311H of the stationary portion 31H. In addition, an inner race of each ball bearing 33H is fixed to an outer circumferential surface of the shaft 321H of the rotating portion 32H. Further, a plurality of balls, each of which is a spherical rolling element, are arranged between the outer race and the inner race. As described above, instead of a fluid dynamic bearing, rolling-element bearings, such as, for example, ball bearings, may be used as a bearing structure of the motor portion 30H.

In the modification illustrated in FIG. 13, the motor portion 30H includes the two ball bearings 33H. The ball bearings 33H are arranged near an upper end and a lower end of an axial range over which the inner circumferential surface of the stator fixing portion 311H and the shaft 321H are opposed to each other. This contributes to preventing the shaft 321H from being inclined with respect to a central axis 9H.

Figure 14:
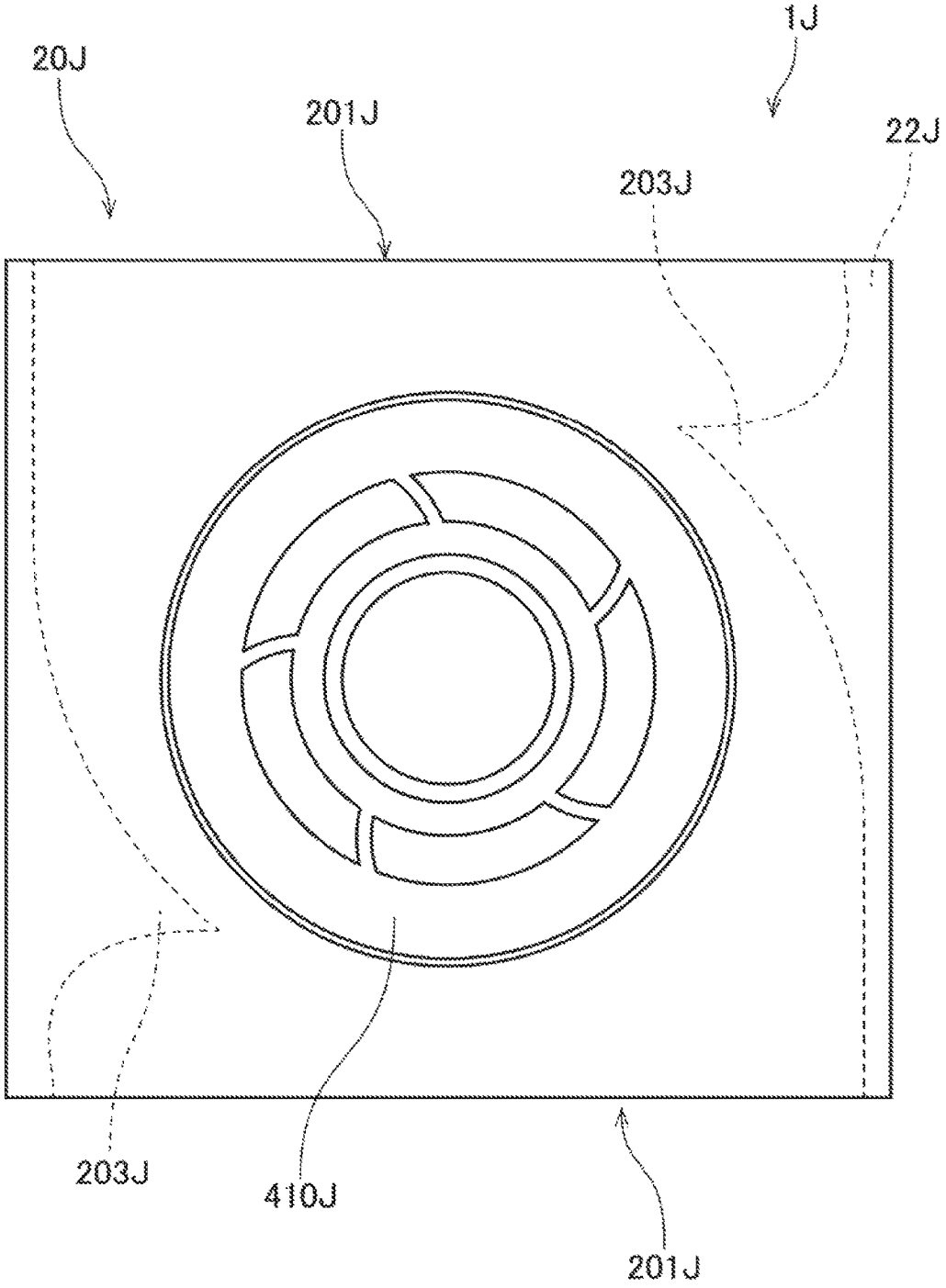
FIG. 14 is a top view of a blower apparatus according to a modification of the first preferred embodiment.

FIG. 14 is a top view of a blower apparatus 1J according to yet another modification of the above-described preferred embodiment. In the blower apparatus 1J according to the modification illustrated in FIG. 14, a housing 20J includes a plurality of air outlets 201J. Specifically, a side wall portion 22J includes the air outlets 201J, each of which is arranged to face in a radial direction, at a plurality of circumferential positions. The housing 20J includes tongue portions 203J, each of which is arranged near a separate one of the air outlets 201J. In addition, an air blowing portion 40J includes a plurality of flat plates 410J and a plurality of spacers. The flat plates 410J are arranged in the axial direction with an axial gap defined between adjacent ones of the flat plates 410J. Each of the spacers is arranged in a region in the axial gap between axially adjacent ones of the flat plates 410J, the region covering a portion of the radial extent of the axial gap.

In a centrifugal fan including an impeller, periodic noise occurs owing to the shape, number, arrangement, and so on of blades. In addition, such noise tends to easily occur around a tongue portion. Accordingly, when air is to be discharged in a plurality of directions, a deterioration in noise characteristics occurs because of an increased number of tongue portions. However, in this blower apparatus 1J, air flows traveling radially outward are generated by rotation of the flat plates 410J, and therefore, the blower apparatus 1J is able to achieve reduced periodic noise when compared to the centrifugal fan including the impeller. Therefore, the blower apparatus 1J, which is designed to discharge air in a plurality of directions, does not significantly deteriorate in noise characteristics due to the tongue portions 203J.

Note that, although the number of flat plates and the number of spacers included in the air blowing portion are six and five, respectively, in each of the above-described preferred embodiment and the modifications thereof, this is not essential to the present invention. The number of flat plates may alternatively be two, three, four, five, or more than six. The number of spacers may alternatively be one, two, three, four, or more than five.

Also note that, although the hub is defined by one or two members in each of the above-described preferred embodiment and the modifications thereof, this is not essential to the present invention. The hub may alternatively be defined by three or more members.

Also note that the detailed shape of any member may be different from the shape thereof as illustrated in the accompanying drawings of the present application. For example, the shape of any of the housing, the air blowing portion, and the motor portion may be different from that according to each of the above-described preferred embodiment and the modifications thereof. Also note that features of the above-described preferred embodiment and the modifications thereof may be combined appropriately as long as no conflict arises.

Preferred embodiments of the present invention are applicable to blower apparatuses.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A blower apparatus comprising:
- an air blowing portion arranged to rotate about a central axis extending in a vertical direction;
- a motor portion arranged to rotate the air blowing portion; and
- a housing arranged to house the air blowing portion and the motor portion; wherein
- the housing includes:
  - an air inlet arranged above the air blowing portion, and arranged to pass through a portion of the housing in an axial direction; and
  - an air outlet arranged to face in a radial direction at at least one circumferential position radially outside of the air blowing portion;
- the air blowing portion includes:
  - a plurality of flat plates arranged in the axial direction with an axial gap defined between adjacent ones of the flat plates; and
  - one or a plurality of spacers each of which is arranged in a region in the axial gap between axially adjacent ones of the flat plates, the region covering a portion of a radial extent of the axial gap;
- the motor portion includes:
  - a stationary portion including an armature; and
  - a rotating portion including a magnet arranged radially outside of the armature, and a hub arranged to hold the magnet; and
- the hub includes:
  - a top plate portion arranged to cover an upper side of the armature;
  - a magnet holding portion arranged to extend downward from the top plate portion to assume a cylindrical shape, and arranged to hold the magnet with an inner circumferential surface thereof; and
  - a flat plate holding portion arranged to extend radially on a radially outer side of the magnet holding portion, and hold at least one of the flat plates.

2. The blower apparatus according to claim 1, wherein the hub includes:
- a hub body member including the top plate portion and the magnet holding portion; and
- a flange member including the flat plate holding portion.

3. The blower apparatus according to claim 1, wherein at least one of the spacers defines a portion of the flat plate holding portion.

4. The blower apparatus according to claim 3, wherein
- the air blowing portion includes the plurality of spacers; and the spacers include a bottom spacer arranged at a lowest position of all the spacers, the bottom spacer defining a portion of the flat plate holding portion.

5. The blower apparatus according to claim 3, wherein the air blowing portion includes the plurality of spacers; and the spacers include a top spacer arranged at a highest position of all the spacers, the top spacer defining a portion of the flat plate holding portion.

6. The blower apparatus according to claim 3, wherein the air blowing portion includes three or more of the spacers;

the spacers include:

a top spacer arranged at a highest position of all the spacers;

a bottom spacer arranged at a lowest position of all the spacers; and one or a plurality of intermediate spacers arranged between the top spacer and the bottom spacer; and at least one of the intermediate spacers defines a portion of the flat plate holding portion.

7. The blower apparatus according to claim 1, wherein a center of the air inlet is arranged to coincide with the central axis.

8. The blower apparatus according to claim 1, wherein the stationary portion further includes a bearing housing;

the rotating portion further includes a shaft and a bearing member;

the bearing housing and a combination of the shaft and the bearing member are arranged to have a lubricating fluid therebetween;

the bearing housing and the rotating portion are arranged to together define a gap defining a seal portion therebetween, the seal portion having a surface of the lubricating fluid defined therein; and in the seal portion, a distance between the bearing housing and the rotating portion is arranged to increase with increasing distance from the surface of the lubricating fluid.

9. The blower apparatus according to claim 1, wherein the motor portion further includes a ball bearing arranged to connect the rotating portion to the stationary portion such that the rotating portion is rotatable with respect to the stationary portion.

10. The blower apparatus according to claim 1, wherein the housing includes a plurality of the air outlets at a plurality of circumferential positions.

* * * * *